US006277252B1

(12) United States Patent
Billman

(10) Patent No.: US 6,277,252 B1
(45) Date of Patent: Aug. 21, 2001

(54) FOLDABLE PLATING APPARATUS

(75) Inventor: Ake Billman, Jarfalla (SE)

(73) Assignee: Toolex Alpha AB, Sundbyberg (SE)

( * ) Notice: Subject to any disclaimer, the term of this patent is extended or adjusted under 35 U.S.C. 154(b) by 0 days.

(21) Appl. No.: 09/310,383

(22) Filed: May 12, 1999

(30) Foreign Application Priority Data

May 19, 1998 (SE) ..... 9801773

(51) Int. Cl.[7] ..... C25B 9/00; C25C 7/00; C25D 17/00

(52) U.S. Cl. ..... 204/242; 204/271; 248/150

(58) Field of Search ..... 204/242, 271; 248/150

(56) References Cited

U.S. PATENT DOCUMENTS 4,187,154 2/1980 Dewallens .
4,391,694 7/1983 Runsten .
4,619,749 * 10/1986 Nusbaum ..... 204/228.6
5,489,076 * 2/1996 Thomas ..... 248/150
5,676,809 10/1997 Billman .

FOREIGN PATENT DOCUMENTS

WO 97/37061 10/1997 (WO) .

* cited by examiner

*Primary Examiner*—Kathryn Gorgos
*Assistant Examiner*—Wesley A. Nicolas
(74) *Attorney, Agent, or Firm*—Young & Thompson

(57) ABSTRACT

An apparatus for electroplating a master, comprising: a frame having a first frame portion (106) supporting an electroplating bath unit (210) and a second frame portion (104) for supporting electrically operated units (240, 250, 260, 270, 140) including a display unit (140). The frame forms a vertically extended construction in an operational state. The first frame portion (106) and the second frame portion (104) are interconnected (108, 300) such that the apparatus is foldable to a transport state for reducing said vertical extension of the apparatus. The first frame portion (106) and the second frame portion (104) forms a single frame in the transport state and in the operating state.

13 Claims, 5 Drawing Sheets

FOLDABLE PLATING APPARATUS

TECHNICAL FIELD OF THE INVENTION

The invention relates to an apparatus for electroplating on a master for obtaining a matrix. Such a matrix may be used for replication of optical discs.

DESCRIPTION OF RELATED ART

A manufacturer of optical discs having an amount of information-to-be-replicated, such as for example a music recording or computer data, needs to obtain a stamper with a pattern corresponding to that information. The pattern of the stamper is a model for information to be transferred to the optical discs. A stamper is manufactured in the following way: A master having a pattern corresponding to the pattern to be on the Optical Discs is manufactured. The patterned, i.e. structured, surface of the master plate is metallized, by depositing a thin conductive layer thereon e.g. by vacuum deposition or sputtering. The step of generating a stamper matrix with the use of the master involves deposition of nickel by electroplating in an electroplating apparatus.

After electroplating, the resulting nickel plate is removed from the master plate. The removal of the nickel plate from the master plate results in a nickel plate having a patterned surface, the pattern being the mirror image of the pattern on the master. That nickel plate constitutes a matrix. The matrix may be used as a stamper matrix in an injection moulding machine for moulding optical discs.

FIG. 1B illustrates a work station according to prior art, including an electroplating bath unit. The electroplating bath, during operation, contains aggressive chemicals and may emit hazardous gases when opening, the lid of the bath unit. FIG. 1C illustrates a cupboard according to the prior art, for use together with the work station shown in FIG. 1B. The cupboard includes control circuitry for the electroplating process, and it is too bulky and too heavy to be lifted by only a few people, e.g by two persons on their own. The prior art work station of FIG. 1B can be used together with the cupboard of FIG. 1C as an electroplating apparatus. Such a prior art electroplating apparatus is illustrated in FIG. 1D. The electroplating apparatus according to the prior art is higher than it is wide. The geometry of the plating apparatus according to the prior art is such that during operation it is a bit over 2 meters high. A display unit is provided in the cupboard. The electroplating bath unit provided in the work station includes parts which are not rigidly attached to the frame of the plating apparatus, but which are movable in the horizontal direction and which are not restrained in the upward direction. These freely movable parts are kept in place by gravitation and are already placed in the work station when delivered from the manufacturer. For these reasons the work station should be kept in an upright position during transport. The work station is too bulky and too heavy to be lifted by a single person.

SUMMARY OF THE INVENTION

The present invention relates to the problem of reducing the time duration from the placement of a purchase order to successful operation of a new plating apparatus at the premises of a manufacturer of optical discs.

The above mentioned problem is solved by providing an electroplating apparatus comprising a frame having a first frame portion supporting an electroplating bath unit and a second frame portion for supporting electrically operated units including a display unit, the frame forming a vertically extended construction in an operational state. The first frame portion and the second frame portion are interconnected such that the apparatus is foldable to a transport state for reducing said vertical extension of the apparatus, the first frame portion and the second frame portion forming a single frame in the transport state as well as in the operating state.

This solution has the advantageous effect of enabling delivery of the plating apparatus with any standard freighter aeroplane, while enabling an easier set up procedure of the plating apparatus after delivery, thereby minimizing the time and work required by service assembly personnel, since the machine can be assembled to a larger extent at the manufacture plant before delivery to the end user. Freighter cargo aeroplanes have restrictions for the height of a piece of cargo. The most frequent cargo aeroplanes require that the cargo has a maximum height of about 1.6 meters, whereas cargo aeroplanes allowing higher pieces of cargo are quite infrequent at many airline routes. The apparatus according to the invention enables the manufacturer/distributor of plating apparatuses to provide fast response to an order, that is fast delivery of a plating construction after receiving an order. This is because in its folded state the plating construction complies with these cargo aeroplane requirements, and hence one of the frequently flying cargo aeroplanes can be used for delivery of the plating construction.

The first portion of the frame is adapted to support the weight of the whole apparatus, since it forms a lower part of the plating apparatus in the operational state.

Additionally the top frame portion of the apparatus acts like a lever during the process of transforming the apparatus from its folded state to its operational state. This significantly reduces the physical effort needed for transforming the plating apparatus from the transport state to the operational state. This advantageously enables a single person to transform the plating apparatus from the transport state to the operational state in a short time.

According to an embodiment the apparatus further comprises electrical conductor connections for connecting electrically operated units in the second frame portion with electrically operated units in the first frame portion. The provision of electrical conductor connections in the apparatus already at the delivery eliminates the need to engage an operator for setting up electrical connections between internal units in the apparatus after delivery, at the premises of a manufacturer of optical discs. Hence, the time duration from delivery to successful operation of a new plating apparatus is reduced.

According to a preferred embodiment the conductor connections include cables which, in the proximity of the axis of rotation around which the apparatus is foldable, are arranged substantially parallel to said axis of rotation. This cable arrangement advantageously reduces stretching or slacking of the cables during folding or unfolding, hence contributing to reducing the probability of electric wiring errors.

DETAILED DESCRIPTION OF EMBODIMENTS

Figure 1A:
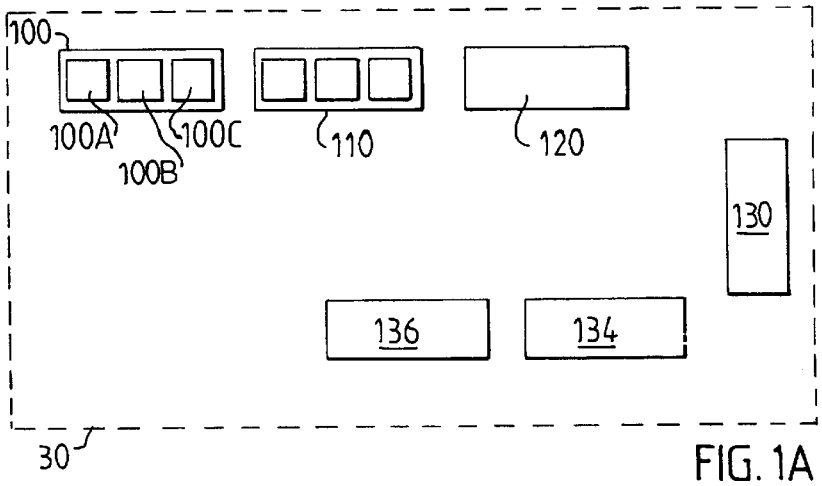
FIG. 1A illustrates a plating arrangement including a plating apparatus.
Figure 1B:
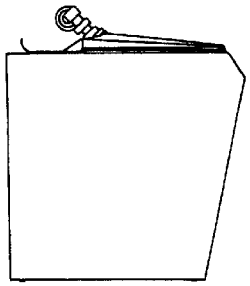
FIG. 1B PRIOR ART
FIG. 1B illustrates a work station according to prior art, including an electroplating bath unit.
Figure 1C:
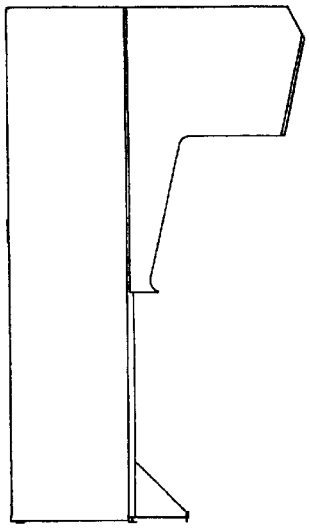
FIG. 1C PRIOR ART
FIG. 1C illustrates a cupboard according to the prior art, for use together with the work station shown in FIG. 1B.
Figure 1D:
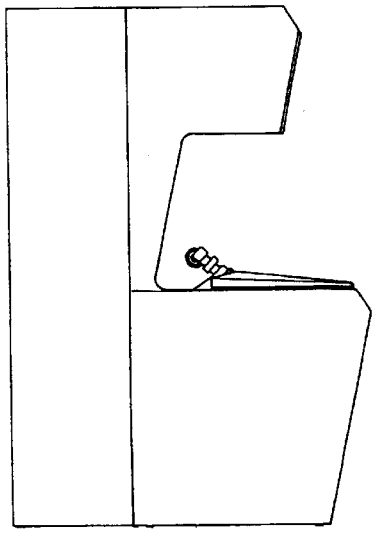
FIG. 1D PRIOR ART
FIG. 1D illustrates the work station shown in FIG. 1B in combination with the cupboard of FIG. 1C.

FIG. 1A illustrates an embodiment of a plating arrangement 30 for the production of stampers. The plating arrangement 30 includes a plating apparatus 100, a preparation unit 110, a spin coating station 120 and an oven 130. The plating arrangement 30 may involve more than one of the apparatuses 100, 110, 120 or 130. Additionally the plating arrangement may include a polishing unit 134 and a punching unit 136.

Figure 2:
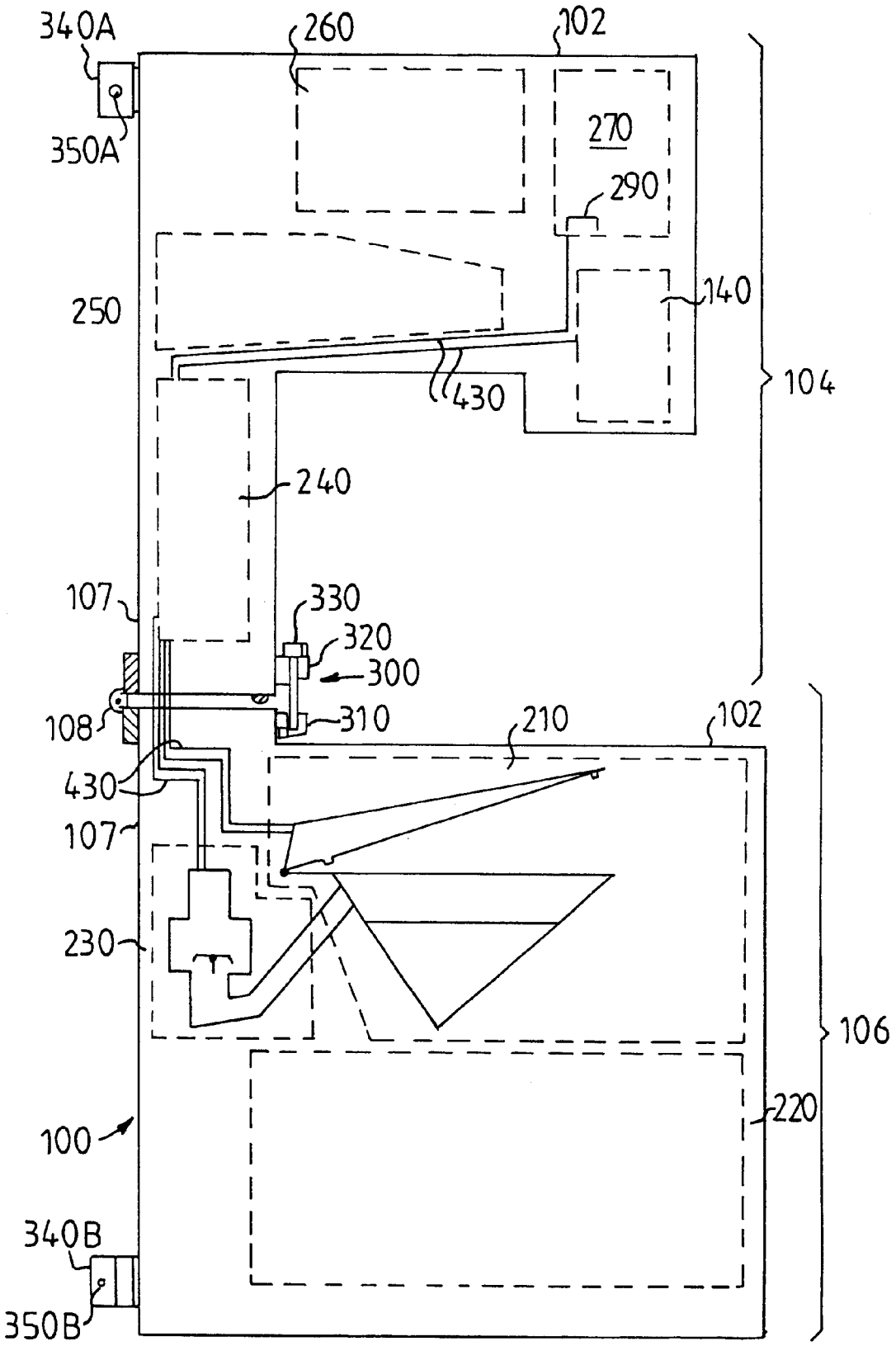
FIG. 2 is a schematic side view of the plating apparatus of FIG. 1A.

FIG. 2 is a schematic side view of the plating apparatus 100. The plating apparatus 100 includes an integral frame 102 having an upper frame portion 104 and a lower frame portion 106. The upper frame portion 104 and the lower frame portion 106 of the frame are interconnected by a hinge mechanism 108 provided in a beam 107. The hinge mechanism is provided at a distance less than 1.3 meters from the bottom side of the lower frame portion 106 of the apparatus 100.

The lower portion 106 of the frame holds a bath unit 210, a tank unit 220 and an exhaust unit 230. The upper portion of the frame holds an electric power supply unit 240, a filter unit 250, a rectifier unit 260, a control unit 270 and a display unit 140. The electroplating bath unit 210 includes parts which are not rigidly attached to the frame of the plating apparatus, but which are movable in the horizontal direction and which are not restrained in the upward direction. These freely movable parts are kept in place by gravitation and are already placed in the lower frame portion of the plating apparatus when a new plating apparatus is delivered from the plating apparatus manufacturer. The filter unit includes a fan and a High Efficiency Particle filter (HEPA-filter) for supplying clean air to the electroplating work space defined by the lower and upper portions of the apparatus in the operating state.

The provision of a unitary frame comprising an upper frame portion and a lower frame portion connected by a hinge mechanism 108 enables the apparatus to be folded. This solution has the advantageous effect of enabling an easy transformation of the apparatus from a transport state (FIG. 4A) to an operational state (FIG. 3), or vice versa.

Figure 3:
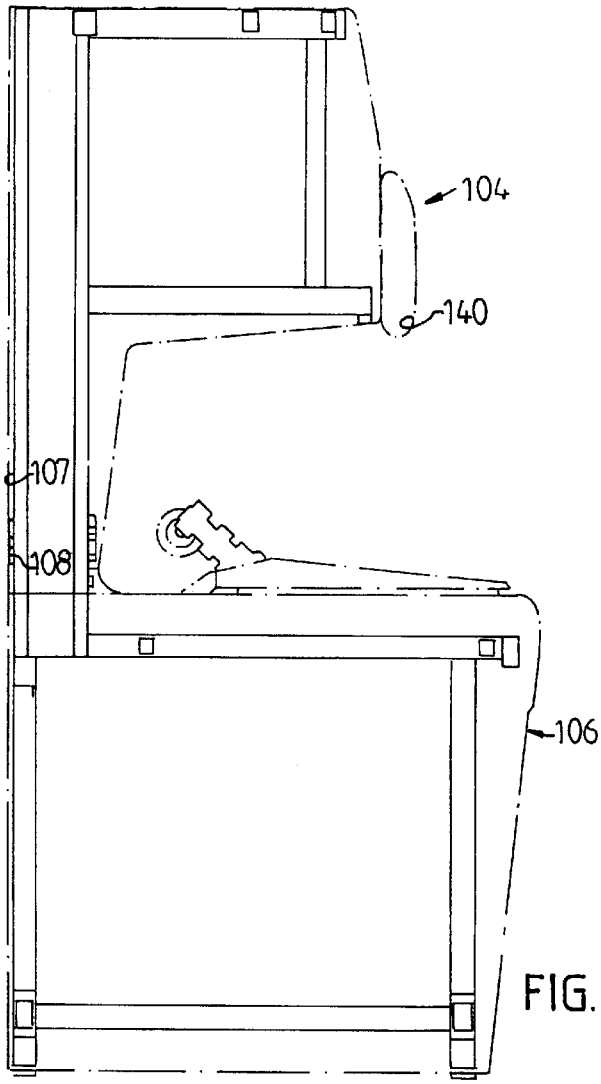
FIG. 3 is a more detailed schematic showing the plating apparatus from FIG. 2 in the unfolded operating mode.
Figure 4B:
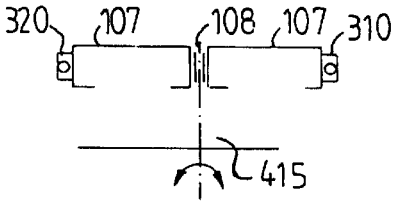
FIG. 4B is a section along the plane A—A in FIG. 4A.
Figure 4A:
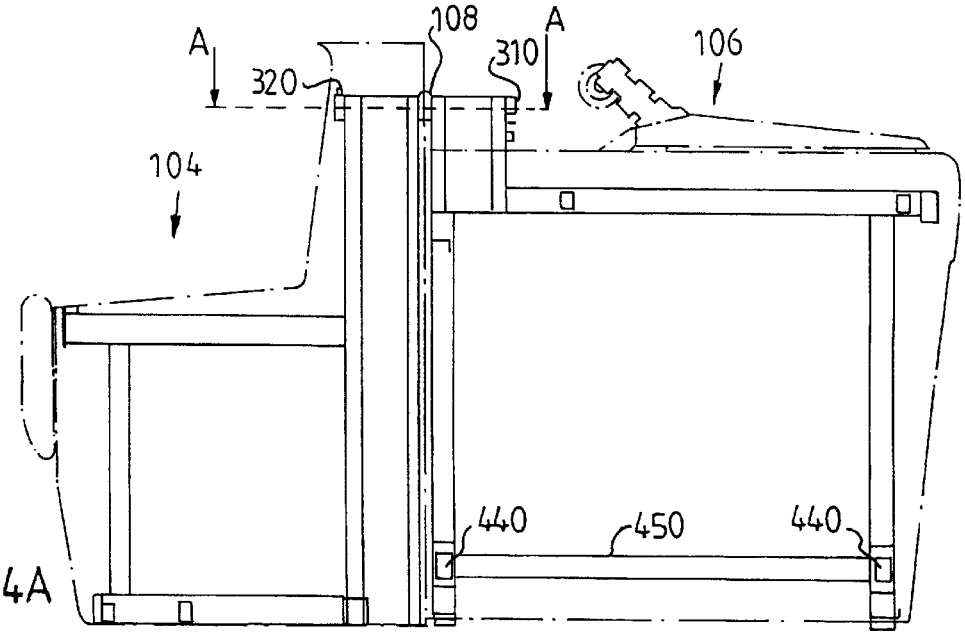
FIG. 4A illustrates the plating apparatus shown in FIG. 3 in a folded state.

A mechanism 300 is provided for releasably locking the apparatus in the operational state, as indicated in FIGS. 2, 3 and 4. According to one version the locking mechanism includes a threaded nut 310 firmly attached to the lower frame portion 106 and a projection 320 firmly attached to the upper frame portion. The projection 320 has an opening through which bolt 330 is mounted so as to be inserted in the nut 310. FIG. 4B is a section along the plane A—A in FIG. 4A illustrating the beam 107 when the apparatus 100 is folded.

According to one embodiment the plating apparatus also includes a mechanism 340A, 340B for releasably locking the apparatus in the folded state. FIG. 2 illustrates schematically a projection 340A provided on the upper rear side of the apparatus 100. The lower rear frame portion of the apparatus 100 is provided with a shaped portion 340B which is positioned so as to receive the projection 340A when the apparatus is in the folded state. The projection 340A and the shaped portion 340B are provided with openings 350A, 350B for receiving a locking bolt 330. According to a preferred embodiment the same bolt 330 may be used for both locking mechanisms 350 and 300.

The machine shown in FIG. 3 requires a floor area less than 3 $m^2$. More precisely the width of the plating apparatus is about 1.34 meters whereas the depth of the plating apparatus is about 1.15 meters, rendering a floor area of 1.54 $m^2$. In the operational state shown in FIG. 3 the height of the plating apparatus is about 2.3 meters. In the folded state illustrated in FIG. 4 the height is less than 1.3 meters.

Since the plating apparatus is lower than 1.6 m in the folded state it is possible to make delivery transports with the use of deliver cargo aeroplanes of a common type which flies very often between all major airports in the world. In effect, the use of a hinge mechanism to connect the two frame portions of the plating apparatus significantly reduces the minimum time from purchase order to installation of the purchased plating apparatus, since a much wider choice of transportation is made available. Quick delivery is an important competitive edge on the market. Thereby the customer having bought the plating apparatus is enabled to quickly start producing articles after having ordered the plating apparatus. A wider choice of transportation also makes it possible to reduce the cost for transportation since freight can be provided by a larger number of alternative freight companies.

The folded plating construction has the advantage of satisfying both of the conflicting requirements of minimizing construction floor area and still obtaining a low construction height during transport while minimizing the bulkiness of the total construction. During transport the folded plating construction is contained in one single piece. The prior art apparatus on the other hand is divided into two, three or more pieces during transport, which complicates the transport procedure.

A further advantage is that it is a lot quicker and easier to move a plating apparatus according to the invention, as compared to that of the prior art. Instead of being obliged to disassemble the apparatus it is possible to simply fold it and move it. In the folded state (FIG. 4A) the centre of gravity is significantly lowered, leading to stable and safe transport of the plating apparatus in one single piece including the top frame portion 104 as well as the bottom frame portion 106.

Figure 5:
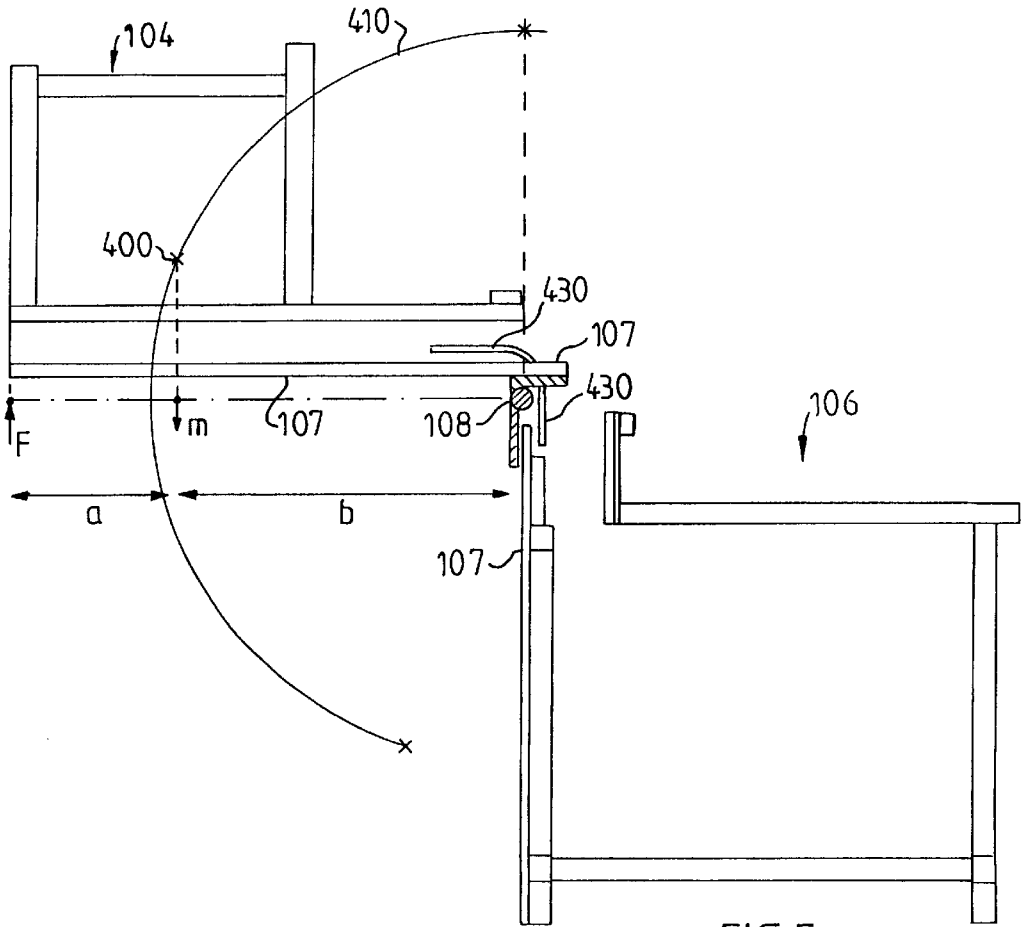
FIG. 5 illustrates the frame of the apparatus in a position half ways between folded and operational state.

According to an embodiment of the invention the top portion of the apparatus including the electric power supply unit 240, the control unit 270 and the display unit 140, but excluding the filter unit 250 and the rectifier unit 260, weighs about 160 kg. When the apparatus has been moved to its new location the process of transforming the apparatus to its operational state is made less strenuous since the personnel never has to lift the whole top part of the apparatus. In the process of transforming the apparatus from its folded state to its operational state a large proportion of the weight rests on the hinge mechanism 108 and additionally the top frame portion 104 acts like a lever. FIG. 5 illustrates the apparatus in a position half ways between folded and operational state. The centre of gravity of the top portion 104 at that position is illustrated by reference 400 and the path along which the centre of gravity moves is indicated by reference 410. At the position shown in FIG. the mass, denoted m, acts on the lever with lengths a–bas indicated in the figure.

The force F which the operator has to apply for raising the top flame portion 104 is significantly lower than the mass m. This advantageously means that it is possible for two persons to transform the plating apparatus from the transport state to the operational state in a short time. This is particularly advantageous because plating apparatuses are often installed in buildings having a ceiling too low to allow for mechanical means of lifting assistance such as an electric hoist. Such low ceiling height leads to the necessity for manually putting the apparatus into operational state.

In prior art apparatuses which are delivered with an electroplating work station and a cupboard with control circuitry as separate entities, it is necessary for the assembly personnel to install cables for connecting e.g. a control panel or power supply in the cupboard with the electroplating bath unit in the work station only after having assembled the two separate pieces at the site where it is to be operated. This is a complex work which is quite time consuming. For the purpose of further reducing the time duration from the placement of a purchase order to successful operation of a new plating apparatus at the premises of a manufacturer of optical discs by reducing the installation time, the apparatus according to an embodiment of the invention includes cabling which is already installed before delivery. The cables connect the electrically operated units in the lower portion 106 of the apparatus with the electric power supply unit 240, the rectifier unit 260, the control unit 270 and the display unit 140 in the top frame portion 104. The electrical connections include power cables for supplying power from the power supply unit 240 as well as cables for supplying rectified current from the rectifier unit 260 to the electrodes in the bath unit. There is also a plurality of signal lines for providing sensor values from the tank unit and from the bath unit to the control unit and to the display unit. Such sensor values include measurement values for indicating liquid levels in the bath and in the tank.

Figure 6:
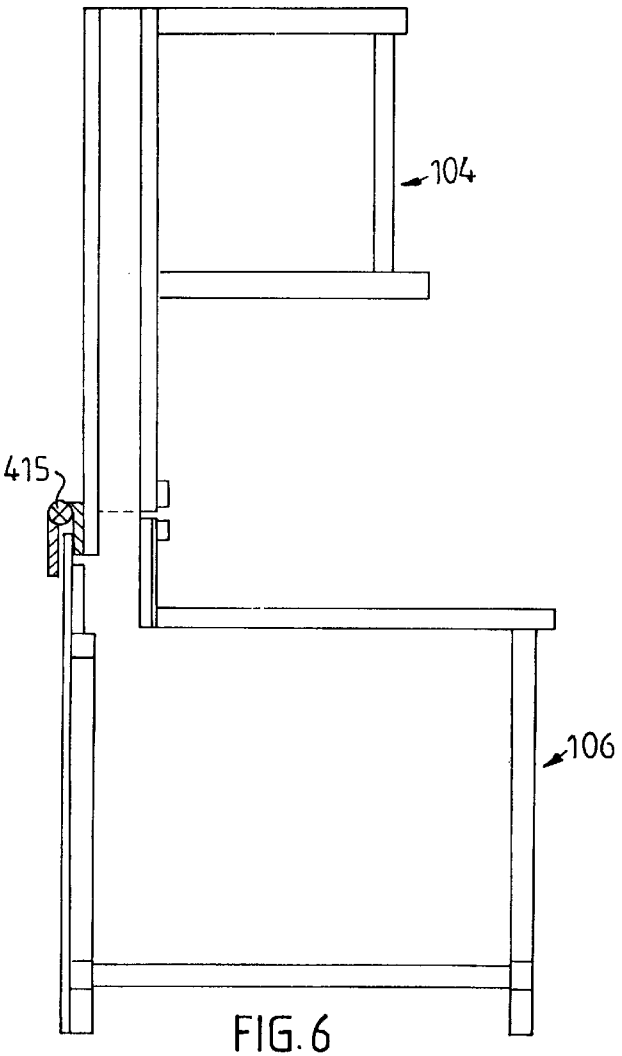
FIG. 6 illustrates the frame of the apparatus in a position corresponding to the operational state of the electroplating apparatus.
Figure 7:
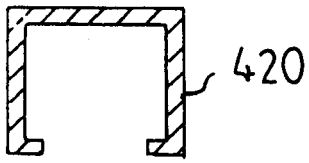
FIG. 7 shows a guide means for holding cables.
Figure 8:
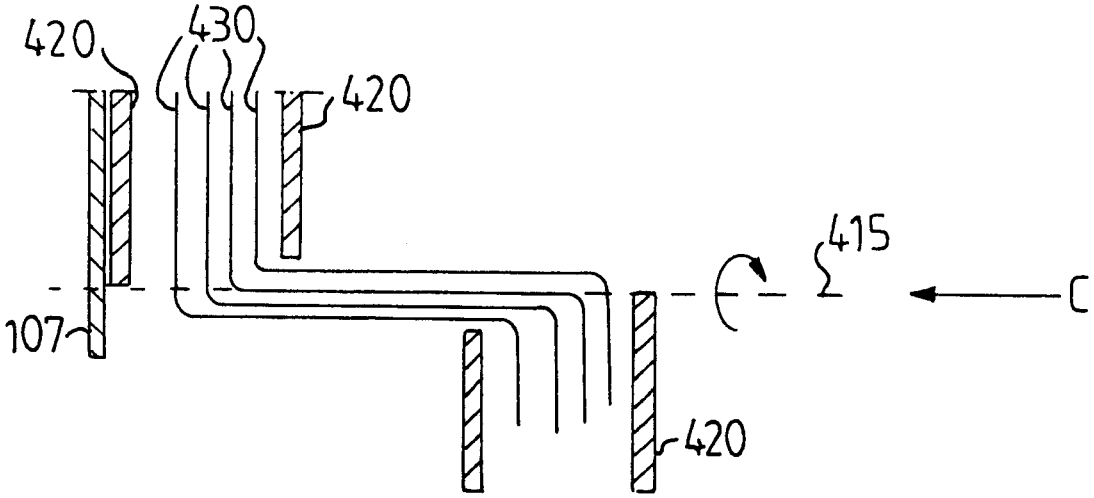
FIG. 8 illustrates an embodiment of a manner of arranging cables.

FIG. 7 illustrates guide means 420 for holding cables 430. Such guide means is provided along a rear wall of the plating apparatus. The guide means 420 may consist of a piece of bent sheet-metal. FIG. 8 illustrates the manner in which the cables are arranged where the plating apparatus is foldable. FIG. 6 illustrates the axis of rotation 415 around which the top frame portion 104 turns. The cables 430 are arranged parallel to the axis of rotation 415 (FIG. 8) along a certain length, thereby avoiding unfavourable stretching or slacking of the cables 430 during the folding or unfolding of the plating apparatus 100. During the folding/unfolding process the cables 430 will be slightly twisted.

The filter unit 250 and the rectifier unit 260 are plug-in units with electrical connectors which mate with corresponding connectors in the top portion 104 of the plating apparatus 100 when plugged in, according to an embodiment.

The apparatus 100 is also provided with recesses 440 adapted for receiving the forks of a fork-lift truck (See FIG. 4A). These recesses allows for quick and easy transportation of the apparatus e.g. within the premises of a manufacturer of optical discs. The apparatus includes two recesses facing the side of the apparatus, and two other recesses facing the front of the apparatus. The front recesses are formed by a horizontally arranged hollow beam 450, as indicated in FIG. 4A.

In the operational state shown in FIG. 3, the plating apparatus may be operated as described below. A master matrix is mounted on a holding fixture. The holding fixture with the attached master matrix is lowered into the liquid in the bath unit 210. A nickel layer is grown on the master by electrolysis so as to create a father matrix. Thereafter the holding fixture with the attached master and father matrices are brought to the preparation unit 10 (See FIG. 1) for separating the father matrix from the master. The father matrix is cleaned, and the information surface is passivated. The passivation is achieved by placing the father matrix in a bath with a suitable liquid.

The father matrix is mounted on a holding fixture. The holding fixture with the attached father matrix is lowered into the liquid in the bath unit 210 for growing a mother matrix on the father matrix. Thereafter the holding fixture with the attached father and mother matrices are brought to the preparation unit 110 for separating the mother matrix from the father matrix. The information surface of the mother matrix is passivated. One father matrix may be used for producing a plurality of mother matrices in this manner.

The mother matrix is subsequently mounted on the holding fixture and used for growing a stamper matrix on the mother matrix in the same manner. Thereafter the holding fixture with the attached mother and stamper matrices are brought to the preparation unit 110 for separating the stamper matrix from the mother matrix. A plurality of stamper matrices may be produced from one mother matrix in this manner.

What is claimed is:

1. An apparatus for electroplating on a master for obtaining a matrix, comprising:

a frame having a first frame portion supporting an electroplating bath unit and a second frame portion for supporting electrically operated units including a display unit, the frame forming a vertically extending construction in an operational state;

characterized in that said first frame portion and said second frame portion are interconnected such that the apparatus is foldable to a transport state for reducing said vertical extension of the apparatus, said first frame portion and said second frame portion forming a single frame with the first and second frame portions being unmovable with respect to one another in the transport state as well as in the operating state.

2. The apparatus according to claim 1, wherein the frame includes a beam having an interconnection means for connecting the first frame portion with the second frame portion; said beam extending vertically when the apparatus is in its operational state.

3. The apparatus according to claim 1, wherein the interconnection means includes at least one hinge mechanism provided at a distance less than 1.6 meters from the bottom side of the first frame portion of the apparatus.

4. The apparatus according to claim 1, further comprising electrical conductor connections for connecting electrically operated units in the second frame portion with electrically operated units in the first frame portion.

5. The apparatus according to claim 4, wherein said conductor connections include cables which, in the proximity of an axis around which the apparatus is foldable, are arranged substantially parallel to said axis of rotation.

6. The apparatus according to claim 1, wherein the first frame portion of the apparatus includes means for receiving forks of a fork-lift truck.

7. The apparatus according to claim 1, wherein the interconnection means includes locking means for releasably locking the apparatus in the transport state or in the operational state.

8. The apparatus according to claim 1, wherein the first frame portion and the second frame portion are of substantially equal size.

9. The apparatus according to claim 1, wherein the apparatus has a height exceeding 1.6 meter in the operational state; and less than 1.6 meter in the transport state.

10. An apparatus for electroplating on a master for obtaining a matrix, comprising:

a first frame portion supporting an electroplating bath unit;

a second frame portion supporting electrically operated units including a display unit, the second frame portion being hingably connected to the first frame portion so that the apparatus may selectively be placed in an operating position or a transport position;

means for securing the first frame portion to the second frame portion in the operating position;

means for securing the first frame portion to the second frame portion in the transport position so that the first frame portion is unmovable with respect to the second frame portion.

11. The apparatus of claim 10, wherein a vertical dimension of the first frame portion and a vertical dimension of the second frame portion are substantially the same.

12. The apparatus of claim 10, wherein a surface of the second frame portion which is uppermost in the operating position is generally aligned with a lowermost surface of the first frame portion when the apparatus is in the transport position.

13. The apparatus of claim 10, wherein the apparatus is operable as an electroplating device while in the operating position, and wherein the apparatus is inoperable as an electroplating device while in the transport position.

* * * * *